US006241569B1

(12) United States Patent
Harkrider

(10) Patent No.: US 6,241,569 B1
(45) Date of Patent: Jun. 5, 2001

(54) SEA WINDOWS FOR RAFTS

(76) Inventor: Kent Harkrider, Marina Del Sol, Winds of Change B/32, 1203 Twin Oak Blvd., Kemah, TX (US) 77565

( * ) Notice: Subject to any disclaimer, the term of this patent is extended or adjusted under 35 U.S.C. 154(b) by 0 days.

(21) Appl. No.: 09/404,243

(22) Filed: Sep. 22, 1999

(51) Int. Cl.[7] ..... B63C 11/00
(52) U.S. Cl. ..... 441/135; 114/66; 350/665
(58) Field of Search ..... 441/135; 114/66; 350/665, 895

(56) References Cited

U.S. PATENT DOCUMENTS

| | | | | |
|---|---|---|---|---|
| D. 315,387 | | 3/1991 | Warren | D21/236 |
| 2,712,139 | | 7/1955 | Kelly | 9/21 |
| 4,691,658 | | 9/1987 | New et al. | 114/66 |
| 4,844,595 | | 7/1989 | Nealy | 350/319 |
| 4,895,539 | | 1/1990 | Bender | 441/135 |
| 5,447,459 | | 9/1995 | Hammond | 441/135 |
| 5,476,055 | * | 12/1995 | Hacket et al. | 114/66 |
| 5,672,082 | | 9/1997 | Binder | 441/135 |

FOREIGN PATENT DOCUMENTS

| | | |
|---|---|---|
| 2 165 186 | 4/1986 | (GB) . |
| 2 188 881 | 10/1987 | (GB) . |

* cited by examiner

*Primary Examiner*—Jesus D. Sotelo
(74) *Attorney, Agent, or Firm*—Richard C. Litman

(57) ABSTRACT

An underwater observation device in combination with a buoyant craft provides an observer with a clear and unobstructed view of underwater scenes. The underwater observation device comprises an upper transparent window, a lower transparent window, and a body portion disposed between the upper transparent window and the lower transparent window. The body portion has a centrally disposed cavity that is filled with a transparent fluid material and a vent for permitting the ingress and egress of the transparent fluid. A person lying in a prone position on a buoyant craft can comfortably peer down into the water and enjoy the underwater scenery. The underwater observation device of the present invention has an innovative design that eliminates visual obstructions such as air bubbles, debris, and condensation.

10 Claims, 11 Drawing Sheets

SEA WINDOWS FOR RAFTS

BACKGROUND OF THE INVENTION

1. Field of the Invention

The present invention relates generally to viewing devices and more particularly, to an underwater observation device. The underwater observation device of the present invention can be an integral part of a flotation craft or a detachable portion of a flotation craft.

2. Description of Related Art

Underwater viewing is an immensely enjoyable recreational activity that is enjoyed by people of all ages. Underwater viewing is often done by snorkeling which requires the use of a face mask and by scuba diving which requires both the use of a face mask and a breathing apparatus. Conventionally, snorkeling involves placing a lens inches from a viewer's eyes. The area between the lens and the viewer's face is encapsulated by a silicon flange. When the viewer places the mask into the water, the distal surface of the mask lens is in complete contact with the water. However, wearing a face mask can become uncomfortable if the face mask is worn for any length of time, therefore, the duration of underwater viewing is curtailed. In the case of scuba diving, underwater viewing is limited by the size of the breathing apparatus and the risks associated with being submerged under water.

An underwater viewing alternative to snorkeling and scuba diving is underwater viewing using a viewing device that is part of a flotation craft. A person lying in a prone position on a flotation craft can comfortably view underwater scenes. However, the underwater viewing experience is diminished when either dirt and debris builds up inside the viewing device or condensation forms on the inner surface of the viewing window, both of which result in an obstructed view. Furthermore, when water splashes onto the viewing surface of the viewing device, there is no way to remove the water because the water is trapped by the collar of the viewing device, therefore, the person using the flotation craft must stand up in the water and invert the flotation craft to remove the water from the viewing surface of the viewing device.

The prior art describes several viewing devices that are part of a flotation craft that are used for underwater viewing. U.S. Pat. No. 2,712,139 issued on Jul. 5, 1955 to E. L. Kelly describes an underwater viewing device that is part of a flotation body. The underwater viewing device consists of a transparent window at the base of a rectangular sleeve that resides inside a well that is formed within the flotation body. The sleeve is constructed of metallic, plastic, or other rigid material. A viewing device for a flotation body is described in U.S. Pat. No. 4,844,595 issued on Jul. 4, 1989 to R. B. Nealy. The viewing device for flotation bodies comprises an open ended cylindrical body and at least one transparent end wall. In one embodiment, a single transparent end wall located at the base of the cylindrical body is used. In a second embodiment, a pair of transparent end walls at opposite ends of. the cylindrical body are utilized. U.S. Des. Pat. No. 315,387 issued on Mar. 12, 1991 to J. R. Warren describes an ornamental design for an underwater viewing paddle board.

U.S. Pat. No. 4,691,658, issued on Sep. 8, 1987 to D. S. New, et al., describes an aquatic sports device that includes a buoyant board configured for supporting a user in a prone position and sized to enable the user to manually paddle while in a prone position. A sight opening is provided through the buoyant board in an optical system configured for enabling the user to look through the board and perceive in a forward direction towards the bow of the buoyant board while paddling. An underwater viewing device is described in U.S. Pat. No. 4,895,539 issued on Jan. 23, 1990 to T. E. Bender. The underwater viewing device consist of a viewing tube having a plurality of opaque sides that project upwardly from a horizontal planar surface made of a transparent material.

A buoyant board for viewing underwater objects while an observer is lying in a prone position is described in U.S. Pat. No. 5,447,459 issued on Sep. 5, 1995 to N. R. Hammond. The buoyant board has a seamless, unitary construction with a viewing well extending through the body of the board that is integrally formed with the body. U.S. Pat. No. 5,672,082 issued on Sep. 30, 1997 to E. Binder describes a floating underwater viewing device. The floating underwater viewing device has a columnar configuration with top and bottom windows. A pair of toroidal floats are circumferentially disposed around the viewing device.

A buoyant platform with a built-in transparent viewing panel is described in British patent document 2,165,186 A published in April, 1986. A raft with a window located at the bow end of the raft is described in British patent document 2,188,881 A published in October, 1987.

None of the above inventions and patents, taken either singly or in combination, is seen to describe the instant invention as claimed.

SUMMARY OF THE INVENTION

Accordingly, it is a principal object of the invention to provide an underwater observation device that makes observing underwater scenery easy and convenient.

It is another object of the invention to provide an underwater observation device that is free of air bubbles, debris, and condensation.

It is a further object of the invention to provide an underwater observation device that is an integral part of a buoyant craft or a detachable portion of a buoyant craft.

Still another object of the invention is to provide an underwater observation device that produces a high quality viewing experience.

It is an object of the invention to provide improved elements and arrangements thereof in an underwater observation device for the purposes described which is inexpensive, dependable and fully effective in accomplishing its intended purposes.

The foregoing objectives are achieved in accordance with the present invention by providing an underwater observation device comprising a walled, fluid filled body and a pair of transparent windows. In a preferred embodiment, the body portion of the underwater observation device has a trapezoidal configuration.

This innovative trapezoidal design allows for a larger underwater viewing area while maintaining a comfortable viewing screen on a buoyant craft.

The cavity of the body portion of the viewing device is filled with a transparent fluid. In the preferred embodiment, the transparent fluid is water. The transparent fluid creates a virtual water level that is only inches from an observer's eyes.

Furthermore, the fluid in the cavity of the body portion prevents air bubbles, debris, or condensation from obstructing an observer's view of underwater scenery. The body of the viewing device has a fluid fill vent for the ready ingress and egress of fluid.

In an alternate embodiment, the underwater observation device comprises a solid unitary (one-piece) construction made of a single solid piece of transparent material that is configured to the desired length, width, depth, and shape. This single piece unitary construction is tantamount to an observation lens because magnification of the underwater scenery is achieved. Any transparent material with the appropriate properties can be used, for example, Plexiglass® or Lexan®.

The underwater observation device of the present invention can be used with any type of buoyant craft, for example, an inflatable buoyant craft or a closed cell buoyant craft. The underwater observation device of the present invention in combination with a buoyant craft provides the casual observer with a comfortable and relaxing underwater viewing experience where all the color and splendor of underwater scenery can be fully appreciated.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
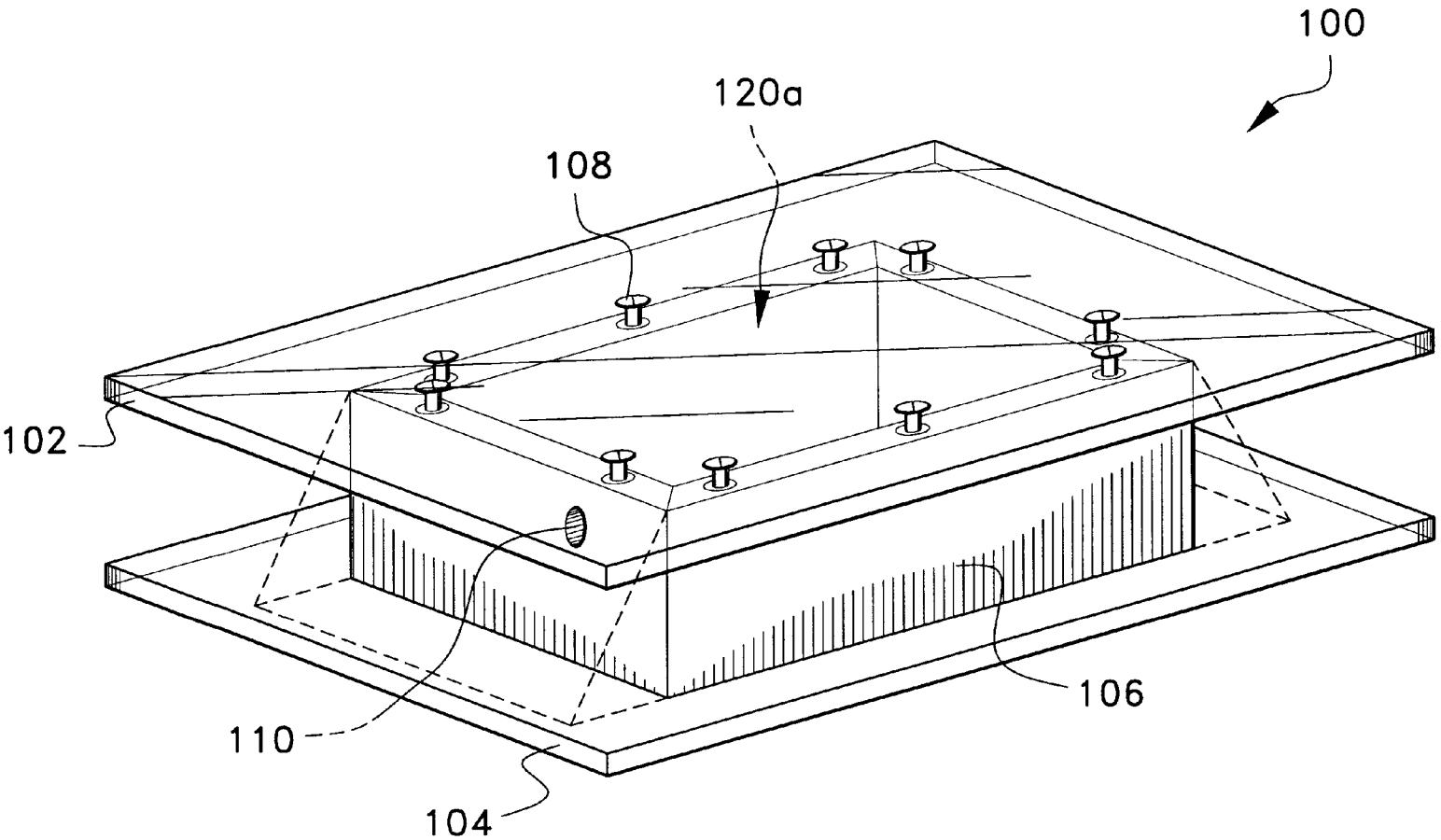
FIG. 1A is a perspective view of an underwater observation device according to the present invention.

Referring to FIG. 1A, which is a perspective view of the underwater viewing device 100 of the present invention, the underwater viewing device 100 comprises an upper transparent window 102, a lower transparent window 104, and a hollow body portion 106. The transparent windows (102, 104) are secured to the body portion 106 using screws 108, however, any suitable means for securing the transparent windows (102, 104) to the body portion 106 could be used. The central cavity 120*a* of body portion 106 is filled with a transparent fluid which prevents dirt and debris from entering the cavity 120*a* and obstructing the view of an observer 118. In addition, the use of a fluid filled cavity 120*a* eliminates other visual impediments such as air bubbles and condensation by excluding air from the cavity 120*a*.

The height of the underwater viewing device 100 is sufficient to prevent the upper transparent window 102 from going below the water level when a buoyant craft 120 employing the viewing device 100 is placed in water. A fluid fill hole or vent 110 is provided in the body portion 106 for the ready ingress and egress of the transparent fluid. The underwater viewing device 100 of the present invention can be fabricated as a single piece unit or can be assembled from the component parts.

In a preferred embodiment, the transparent fluid is water, the transparent windows (102, 104) are made of Plexiglass®, and the body portion 106 has a trapezoidal configuration with a trapezoidally shaped cavity. This trapezoidal configuration provides for an expanded underwater view while ensuring the appropriate size of the viewing window 102 at the level of the observer's eyes. The scenic view provided by the trapezoidally configured underwater viewing device 100 of the present invention is so clear and so vivid that there is the same perception of magnification of the underwater scene as experienced when snorkeling.

Figure 1B:
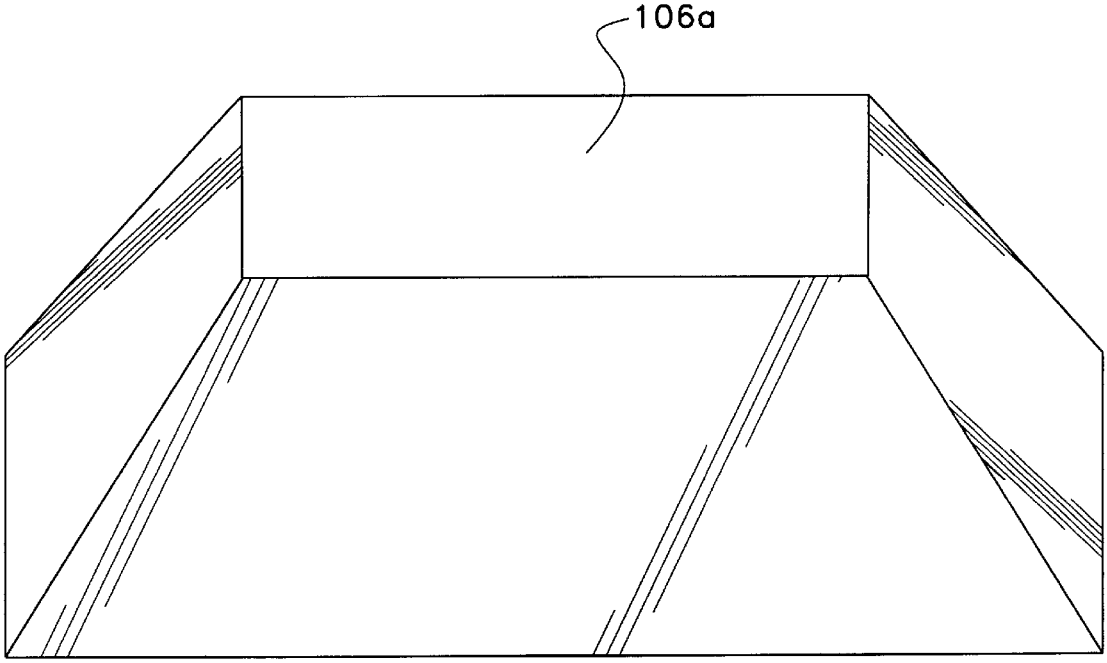
FIG. 1B is a perspective view of a single solid piece of transparent material used to form the body portion of the underwater observation device.

FIG. 1B is a perspective view of a single solid piece of transparent material 106*a*, such as Plexiglass®, used to form the body portion 106 of the underwater viewing device 100. When used in the underwater viewing device 100 of the present invention, the single solid piece of transparent material 106*a* can be vertically disposed as depicted in FIG. 1B or can be horizontally disposed.

In a preferred embodiment, the single solid piece of transparent material 106*a* has a trapezoidal configuration as shown in FIG. 1B.

Figure 1C:
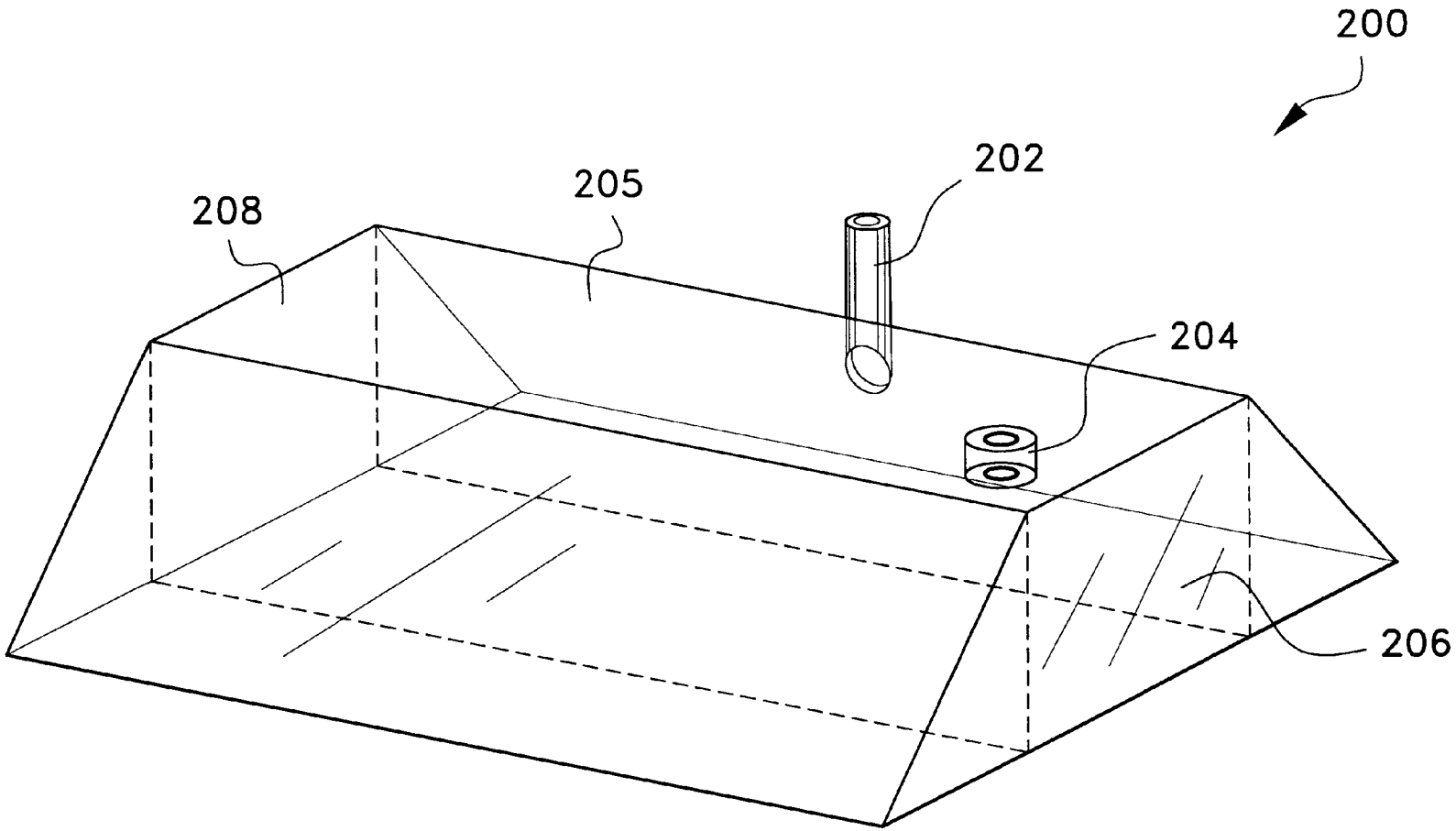
FIG. 1C is a perspective view of a first alternate embodiment of the underwater observation device.

FIG. 1C is a perspective view of a first alternate embodiment of the underwater observation device 200. The embodiment depicted in FIG. 1C employs a single transparent piece of material 200 with a centrally disposed cavity 206. The observation device 200 can be either vertically or horizontally disposed within a buoyant craft.

The centrally disposed cavity 206 is filled with a transparent liquid (not shown), preferably water. The transparent liquid raises the virtual water level to within inches of an observer's eyes. After the transparent liquid has been removed from the centrally disposed cavity 206, the single piece construction shown in FIG. 1C is collapsible for easy storage and transport.

The first alternate embodiment utilizes a fluid fill vent (202, 204) for the ready ingress and egress of the transparent liquid. In one embodiment, the fluid fill vent is a raised orifice 204 disposed on the top surface 208 of the underwater observation device 200. A raised orifice 204 allows the transparent liquid to follow the exiting air up into the orifice 204 which ensures the total evacuation of all air bubbles. In a second embodiment, the fluid fill vent is a tube 202 coming out of the wall 205 of the observation device 200 that rises upward and extends slightly above the top surface 208 of the observation device 200.

Figure 1D:
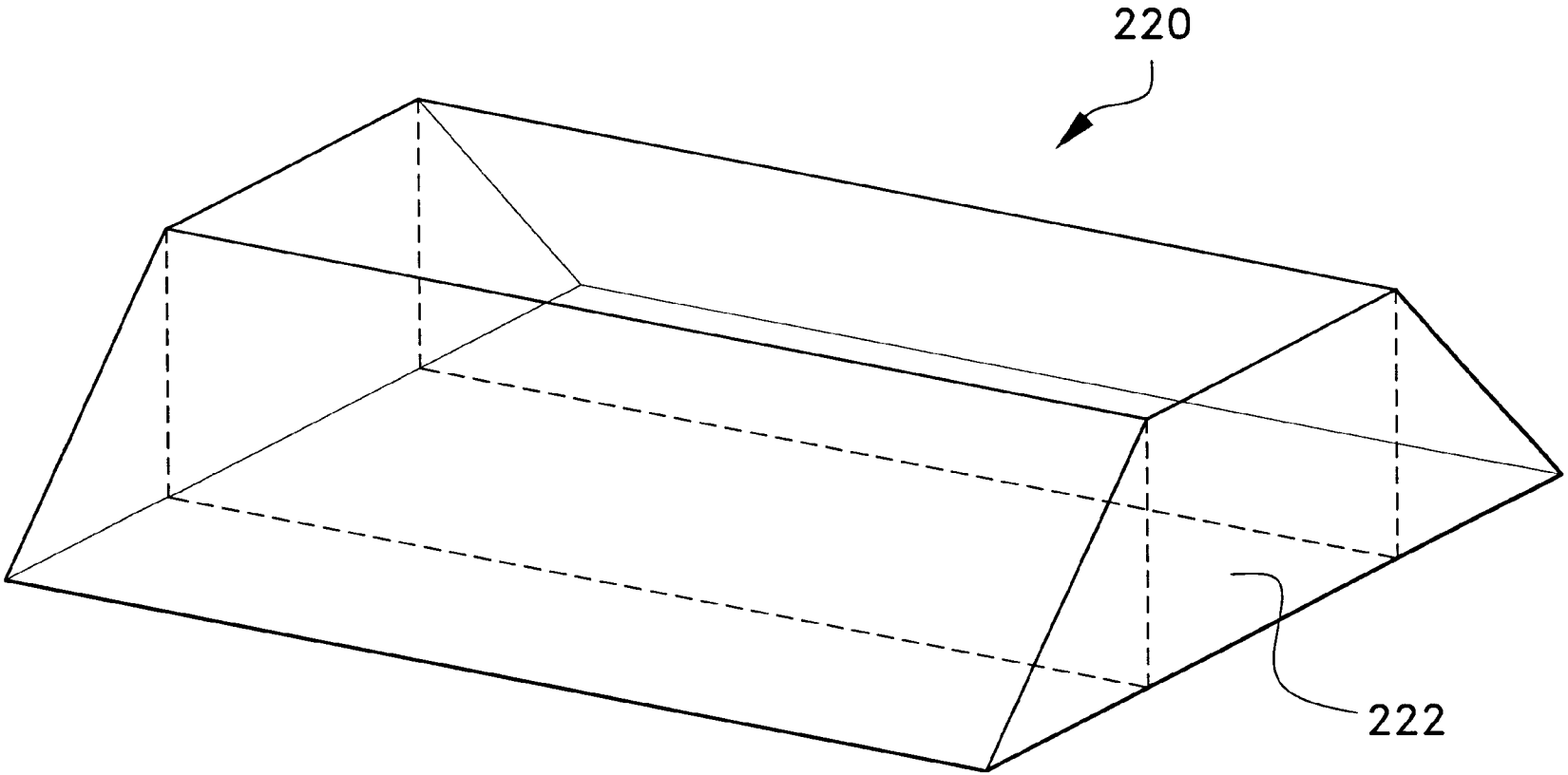
FIG. 1D is a perspective view of a second alternate embodiment of the underwater observation device.

FIG. 1D is a perspective view of a second alternate embodiment of the underwater observation device 220. In the embodiment depicted in FIG. 1D, the observation device 220 has a configured unitary construction, that is, the observation device 220 is a made of a single solid piece of transparent material. The observation device 220 can be either vertically or horizontally disposed within a buoyant craft. In a preferred embodiment, the observation device 220 is made of polycarbonate. The observation device 220 can have a trapezoidal configuration, a rectangular configuration, or any other desired configuration. In this embodiment, the central region 222 of the observation device 220 is solid.

Figure 2A:
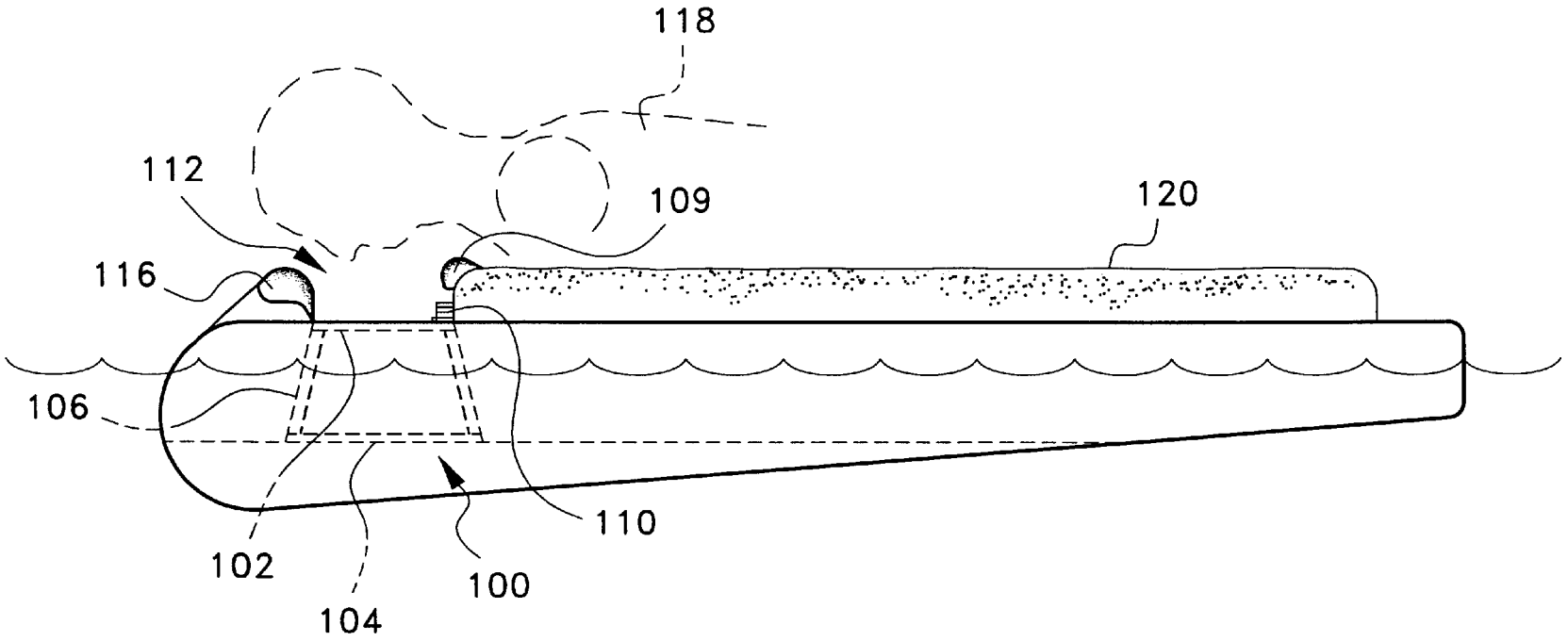
FIG. 2A is a side view of an unpowered buoyant craft with the underwater observation device.

FIG. 2A is a side view of an unpowered buoyant craft or pontoon 120 that employs the underwater viewing device 100 of the present invention. The underwater observation device 100 can be an integral part of a buoyant craft 120, that is, the observation device 100 can be incorporated in the buoyant craft 120 at the time the craft 120 is manufactured 120 or the viewing device 100 can be a detachable portion of a buoyant craft 120, that is, the viewing device 100 can be installed in a buoyant craft 120 that has an opening to accommodate the viewing device 100. The lower transparent window 104 of the viewing device 100 is not flush with the bottom of the buoyant craft 120 which prevents the lower transparent window 104 from scraping the ground when the buoyant craft 120 is not in the water while the upper transparent window 102 may rest on a lip or flange (not shown). The observation area 112 is ergonomically designed with a head rest 116 and a chin rest 109 for maximum comfort so that a person 118 may look through the viewing device while lying in a prone position.

Figure 2B:
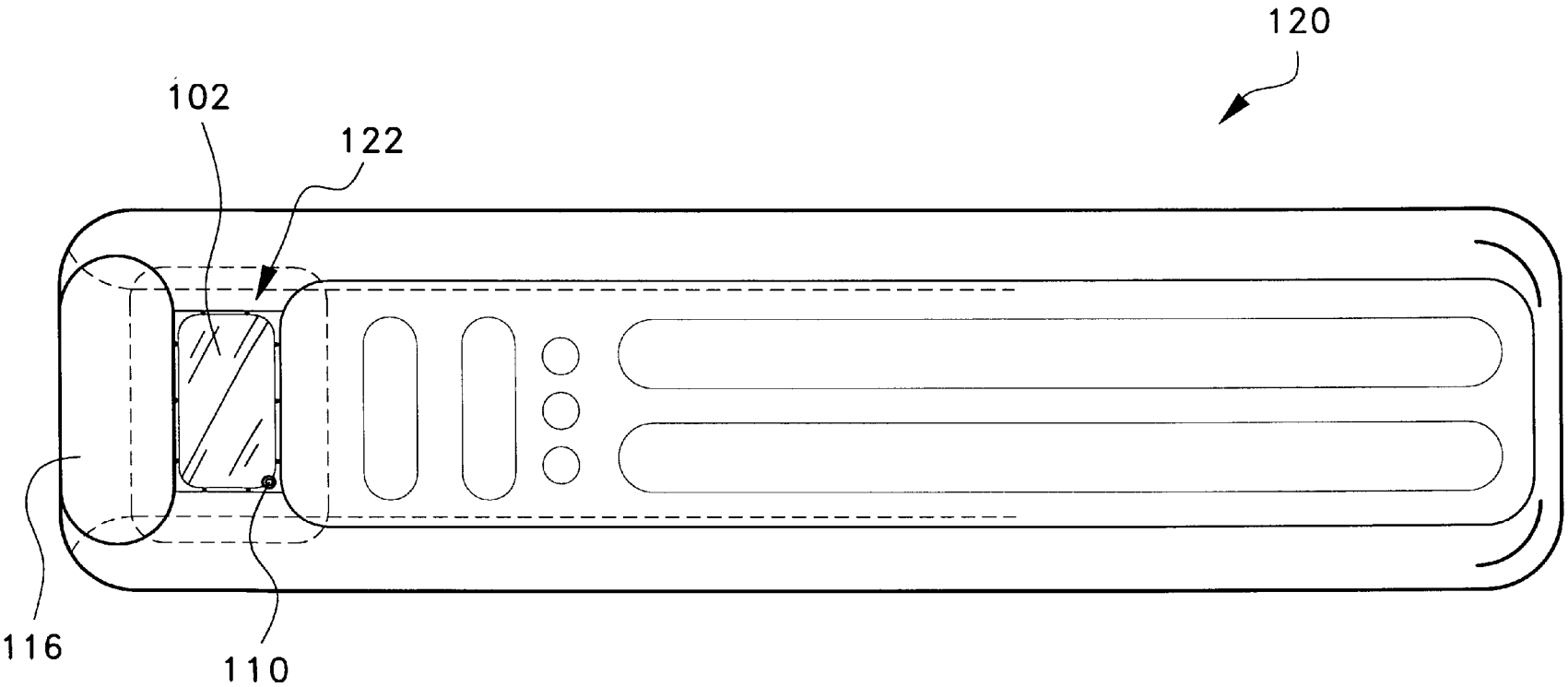
FIG. 2B is a top view of an unpowered buoyant craft with the underwater observation device.
Figure 2C:
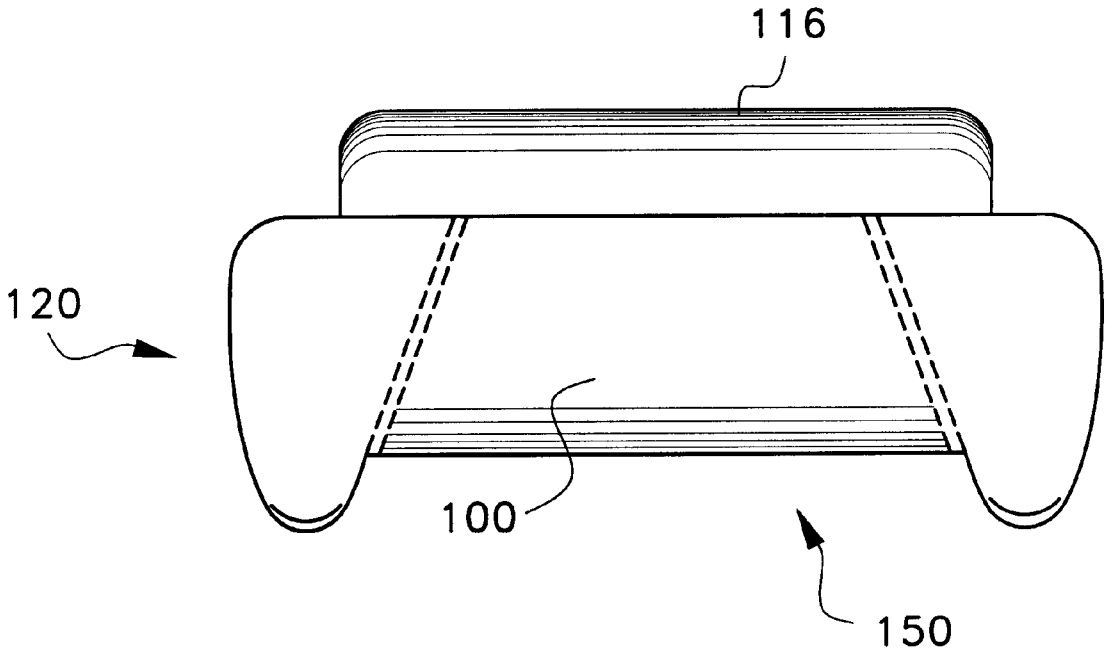
FIG. 2C is a front view of an unpowered buoyant craft with the underwater observation device.

FIG. 2B is a top view of the unpowered buoyant craft 120 showing the viewing compartment 122 of the craft 120. A person lying in a prone position on the craft 120 comfortably views the underwater scenery through the viewing device 100 of the present invention. A person 118 rests his forehead on a padded headrest 116 as he peers down into the clear blue waters and enjoys the scenery. FIG. 2C is a front view of the unpowered buoyant craft 120. A lengthwise cavity 150 disposed along the bottom surface of the buoyant craft 120 serves to allow air trapped beneath the buoyant craft 120 to escape as the buoyant craft 120 is lowered into the water. A lengthwise groove (not shown) along the bottom surface of a buoyant craft 120 could be used to release trapped air instead of a cavity as depicted in FIG. 2C.

Figure 3A:
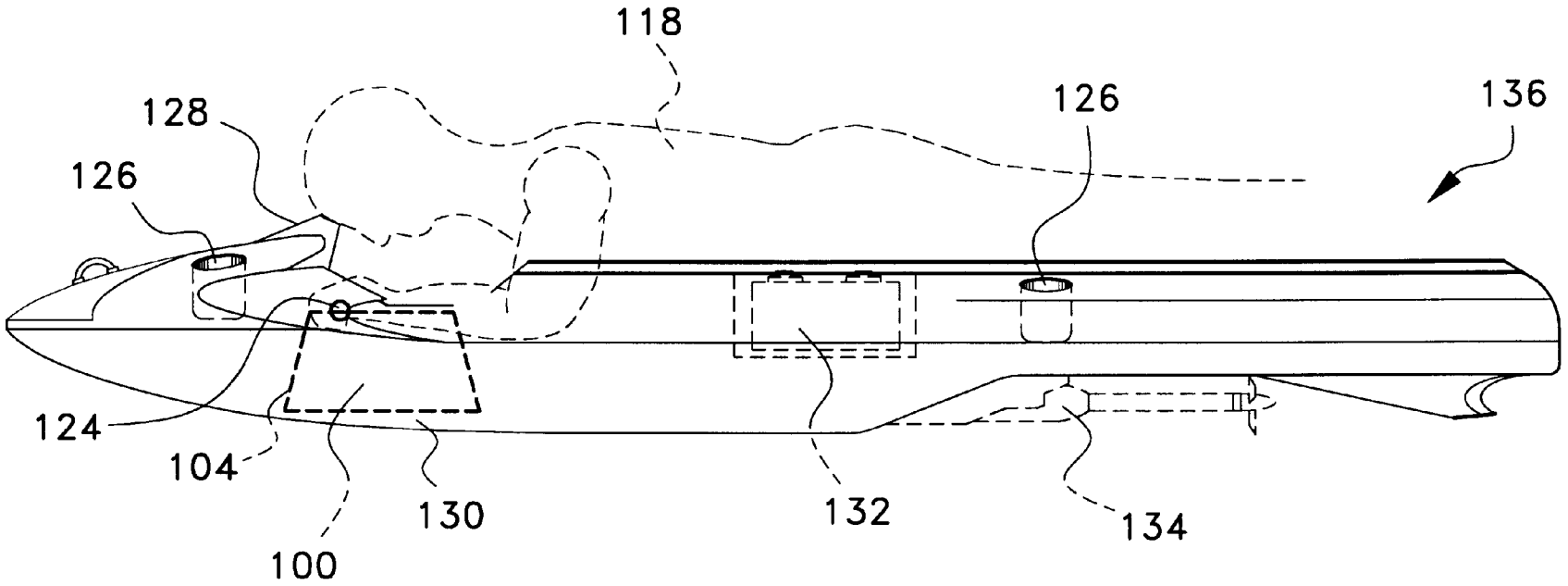
FIG. 3A is a side view of a first embodiment of a powered buoyant craft with the underwater observation device.
Figure 3B:
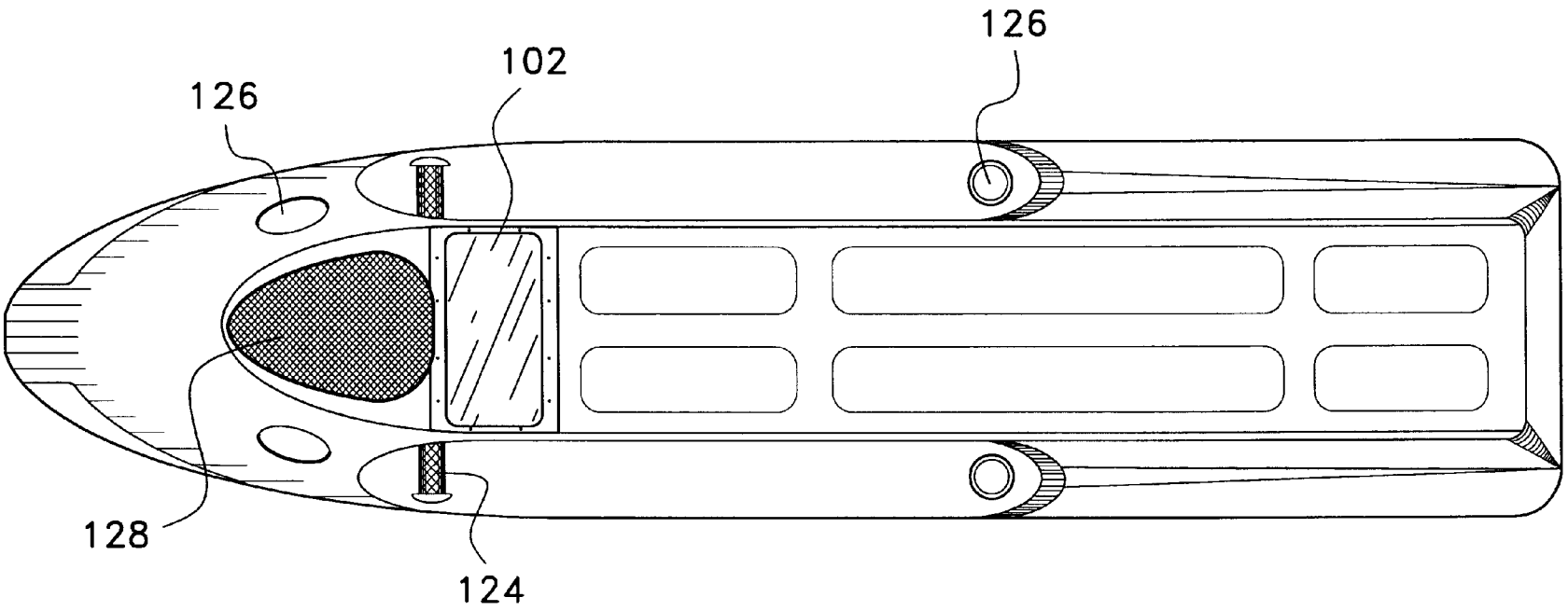
FIG. 3B is a top view of a first embodiment of a powered buoyant craft with the underwater observation device.
Figure 4A:
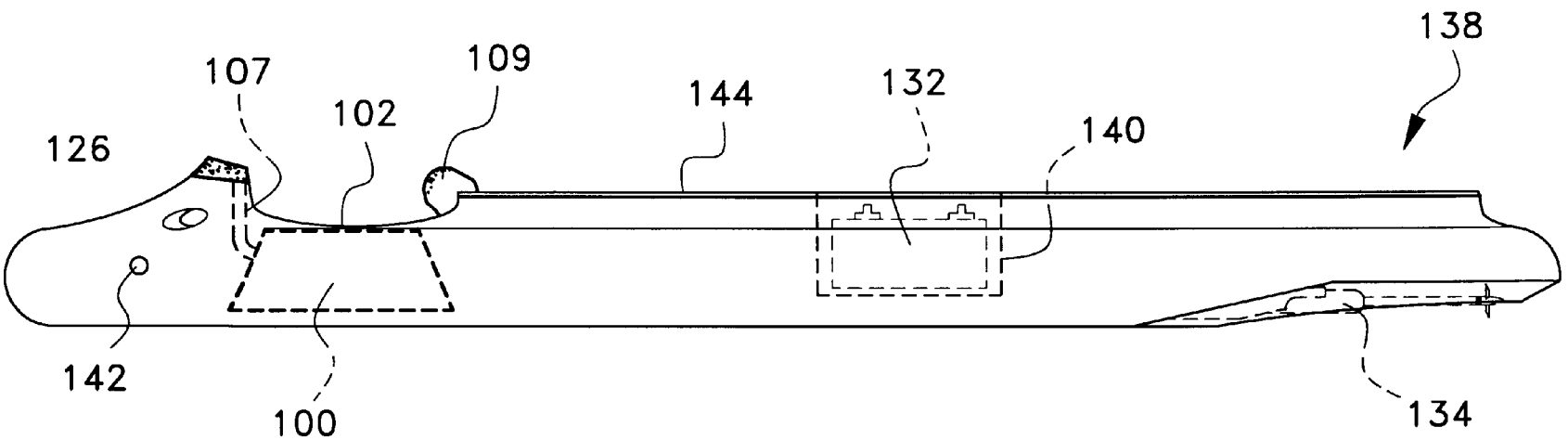
FIG. 4A is a side view of a second embodiment of a powered buoyant craft with the underwater observation device.
Figure 4B:
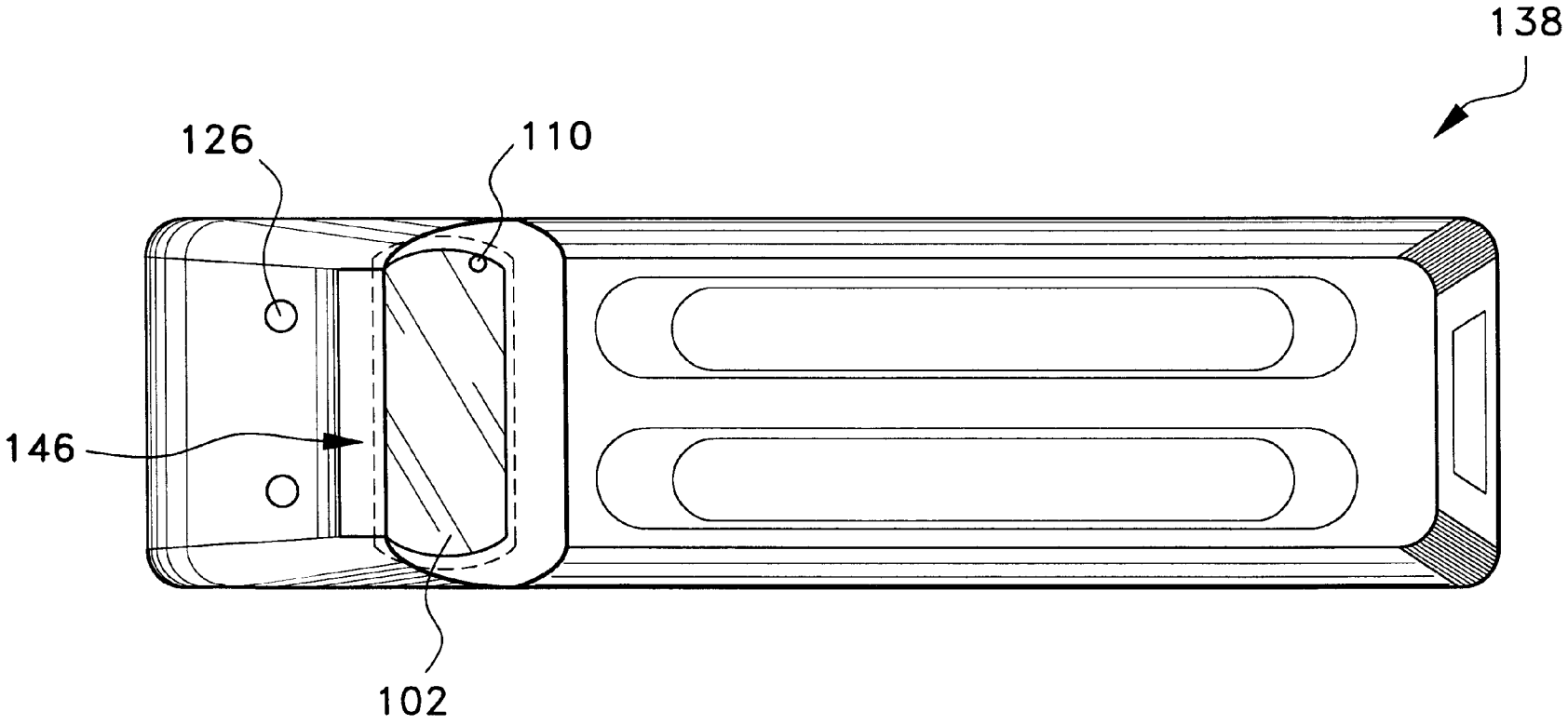
FIG. 4B is a top view of a second embodiment of a powered buoyant craft with the underwater observation device.

FIGS. 3A and 3B are side and top views, respectively, of a first embodiment of a powered buoyant craft 136 employing the underwater viewing device 100. The viewing device 100 is disposed in a recess 130 to prevent incidental contact with underwater objects that could the damage the lower transparent window 104 of the viewing device 100. The powered buoyant craft 136 depicted in FIG. 3A has front and side cupholders 126, a battery 132 power source, a pair of control bars 124 for controlling the speed and direction of the craft 136, and a trolling motor 134. FIGS. 4A and 4B are side and top views, respectively, of a second embodiment of a powered buoyant craft 138 employing the underwater observation device 100. The power feature (twelve volt propulsion) is optional in this embodiment. When the trolling motor 134 is included as a feature of this embodiment, the battery 132 power source is located in a rear compartment 140. However, when the power feature is not included, the rear compartment 140 can be used to store an ice chest. This embodiment has a cushion 144 for added comfort, a pair of front cupholders 126, a pair of drains 142 for the cupholders 126, and a larger viewing area 146. The top surface 102 of the observation device 100 is flush with the beam (not shown) of the craft 138 to prevent the accumulation of water and/or sand on the upper viewing surface 102, For example, any water that splashes onto the observation surface 102 can be readily removed by simply tilting the buoyant craft 138 in either direction. The location of the fluid fill vent 107 is shown in FIG. 4A.

The underwater observation device 100 of the present invention can be employed in any suitable type of buoyant craft, for example, an inflatable buoyant craft or a closed cell buoyant craft. The configuration of the body portion 106 of the underwater viewing device 100 can be varied, for example, in FIG. 1A, the body portion 106 has a rectangular configuration. The underwater observation device 100 of the present invention provides the observer with a crystal clear view of underwater scenery.

The underwater observation device of the present invention overcomes the problems associated with prior art underwater viewing devices such as the many problems encountered when snorkeling such as mask discomfort, fogging, leaking, and water intake into the snorkel. The underwater observation device of the present invention stimulates snorkeling by bringing the underwater scenery to within inches of an observer's eyes. The observation area can have any desired configuration, for example, oblong, trapezoidal, or rectangular. The trapezoidal configuration with its larger, expanded bottom surface creates a greater lateral and horizontal range of view. The underwater observation device of the present invention is essentially a portable window to the underwater world.

The underwater observation device can easily be employed in short board buoyant crafts and when the observation device is employed with an inflatable buoyant craft, the inflated buoyant craft can be deflated and the observation device conventionally transported in a specially designed travel bag.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiments described above, but encompasses any and all embodiments within the scope of the following claims.

I claim:

1. An underwater observation device comprising:

an upper transparent window;

a lower transparent window;

a body portion disposed between said upper transparent window and said lower transparent window, said body portion comprising a single configured unitary piece of transparent material and having a centrally disposed cavity;

a transparent fluid disposed in and filling said cavity;

a venting means for the ingress and egress of said transparent fluid; and a connecting means for connecting said transparent windows to said body portion.

2. The underwater observation device according to claim 1, wherein said transparent windows are made of plexiglass.

3. The underwater observation device according to claim 1, wherein said body portion has a rectangular configuration.

4. The underwater observation device according to claim 1, wherein said body portion has a trapezoidal configuration.

5. The underwater observation device according to claim 1, wherein said transparent fluid is water.

6. The underwater observation device according to claim 1, wherein said transparent windows are made of polycarbonate.

7. An underwater observation device comprising a single configured unitary piece of transparent material, wherein said unitary piece of transparent material is a solid piece of transparent material.

8. An underwater observation device according to claim 7, wherein said unitary piece of transparent material has a trapezoidal configuration.

9. An underwater observation device according to claim 7, wherein said unitary piece of transparent material is made of polycarbonate.

10. An underwater observation device in combination with a buoyant craft comprising:

a buoyant craft having an underwater observation device disposed in an ergonomically designed observation area with a head rest and a chin rest, said underwater observation device including an upper transparent window, a lower transparent window, a body portion disposed between said upper transparent window and said lower transparent window, wherein said observation device comprises a single configured unitary piece of transparent material and has a centrally disposed cavity, a transparent liquid disposed in and filling said cavity;

a venting means for the ingress and egress of said transparent liquid; and a connecting means for connecting said transparent windows to said body portion.

* * * * *